US005125330A

United States Patent [19]

Reist

[11] Patent Number: 5,125,330

[45] Date of Patent: Jun. 30, 1992

[54] PROCESS FOR PRESSING FOLDED PRINTING PRODUCTS

[75] Inventor: Walter Reist, Hinwil, Switzerland

[73] Assignee: Ferag AG, Switzerland

[21] Appl. No.: 579,959

[22] Filed: Sep. 10, 1990

[30] Foreign Application Priority Data

Sep. 13, 1989 [CH] Switzerland ..... 03338/89

[51] Int. Cl.[5] ..... B30B 13/00

[52] U.S. Cl. ..... 100/35; 100/41; 100/153; 100/176; 271/272

[58] Field of Search ..... 100/35, 41, 90, 151, 100/152, 153, 154, 155 R, 160, 168, 173, 176; 271/202, 204, 272

[56] References Cited

U.S. PATENT DOCUMENTS

| | | | |
|---|---|---|---|
| 3,044,772 | 7/1962 | Trenner . | |
| 3,239,676 | 3/1966 | Pali . | |
| 3,257,110 | 6/1966 | Smethurst | 100/153 X |
| 3,473,244 | 10/1969 | Milone et al. | 100/153 X |
| 3,545,371 | 12/1970 | Reist | 100/176 |
| 3,669,008 | 6/1972 | Reist | 100/35 |
| 4,456,242 | 6/1984 | Morin . | |
| 4,534,550 | 8/1985 | Reist | 271/272 X |
| 4,538,161 | 8/1985 | Reist . | |
| 4,566,582 | 1/1986 | Linder . | |
| 4,619,728 | 10/1986 | Brink | 100/176 X |
| 4,953,843 | 9/1990 | Reist . | |

FOREIGN PATENT DOCUMENTS

| | | |
|---|---|---|
| 0038918 | 11/1981 | European Pat. Off. . |
| 0326518 | 8/1989 | European Pat. Off. . |
| 590480 | 1/1934 | Fed. Rep. of Germany . |
| 2027422 | 11/1974 | Fed. Rep. of Germany . |
| 2820957 | 12/1978 | Fed. Rep. of Germany . |
| 3517775 | 1/1986 | Fed. Rep. of Germany . |
| 566925 | 9/1975 | Switzerland . |

*Primary Examiner*—Harvey C. Hornsby
*Assistant Examiner*—Stephen F. Gerrity
*Attorney, Agent, or Firm*—Oliff & Berridge

[57] ABSTRACT

Printing products (44) are inclined in an imbricated formation (S) and with respect to a conveying direction (F) and are led into a pressing nip defined by two pressing rolls (22') pretensioned toward one another. The pressing roll (22') thus rolls in the course of the further conveying of the printing products (44) along a folded edge (46) of the printing product, which results in an especially good pressing action.

6 Claims, 1 Drawing Sheet

PROCESS FOR PRESSING FOLDED PRINTING PRODUCTS

BACKGROUND OF THE INVENTION

1. Field of the Invention

The present invention relates to a process for pressing folded printing products and an apparatus for carrying out the process.

2. Description of the Related Art

In order to ensure a reliably safe further processing of folded printing products which are usually delivered in an imbricated formation, it is often necessary to press these printing products, in particular in order to compress the printing products in the region of the folded edge. the so-called back of the printing product, where they are thicker and "lighter" because of the fold. In the process, the printing products, overlapping each other in the manner of roof tiles, viewed in the conveying direction, are usually fed with folded edges running at right angles to the conveying direction and side edges aligned with one another to a pressing nip defined by two pressing rolls pretensioned toward one another and whose inlet runs parallel to the folded edges, in other words at right angles to the conveying direction. The thickness of the imbricated formation thus alters abruptly along the entire width of the imbricated formation, which results in an unsmooth pressing process. The thickness of the pressing nip must be adapted to these large changes in thickness of the imbricated formation fed to it. This may result in the printing products being inadequately pressed in the region of the folded edges and in the pressing rolls not running smoothly.

SUMMARY OF THE INVENTION

The object of the present invention is therefore to propose a process for pressing folded printing products in which optimum pressing of the printing products is obtained, in particular in the region of the folded edge, and to provide an apparatus for carrying out the process.

According to the invention, the printing products are fed to the inlet of a pressing nip with edges running inclined to the conveying direction. The folded edge of a printing product is thus not simultaneously pressed along its entire length but enters the inlet with one end leading and is gradually led into the pressing nip. The pressing along the folded edge, and incidentally also the further edges of the printing products, takes place progressively, similar to folding or pressing using a folding stick which is drawn along the folded edge. This results in an optimum pressing of the printing products. The air present in the printing product, in particular in the region of the folded edge, can escape without difficulty and, furthermore, the amount of air which must escape from the printing products per unit of time is smaller than the amount of air which must escape in the same time when the printing product enters the pressing nip along the entire length of the folded edge.

An especially consistent pressing process and smooth running of the apparatus for pressing the printing products is obtained if the printing products overlap each other regionwise, viewed in the conveying direction. In this case, a printing product enters the inlet of the pressing nip before the preceding printing product has already completely passed through the inlet (viewed in the conveying direction). The slightest of changes in the thickness of the fed formation, and hence the slightest of changes in the thickness of the pressing nip, takes place when the folded edges of two successive printing products overlap each other, viewed in the conveying direction. Because of the inclined position of the printing products, the folded edges are thus offset relative to one another in a direction at right angles to the conveying direction such that the fed formation to be pressed essentially always has the same thickness. This applies both to formations in which the printing products are not arranged next to one another and lying on top of one another regionwise, and to imbricated formations in which the printing products lie on one another in the manner of roof tiles, viewed in the conveying direction.

Preferred developments of the process according to the invention and embodiments of the apparatus according to the invention are also provided.

BRIEF DESCRIPTION OF THE DRAWINGS

The present invention will now be described in more detail with reference to an exemplary embodiment shown in the drawings, in which purely schematically.

DETAILED DESCRIPTION OF PREFERRED EMBODIMENTS

Figure 1:
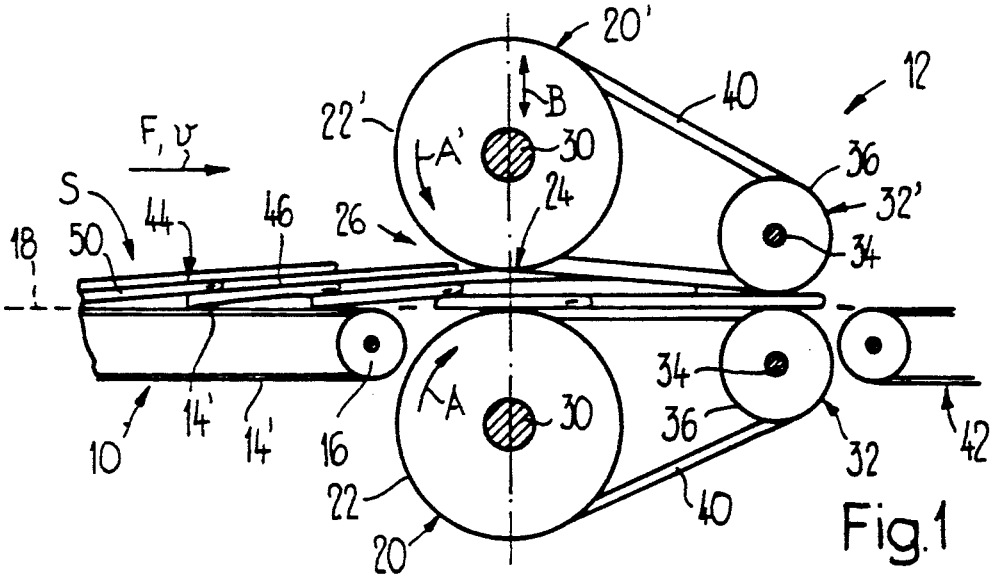
FIGS. 1 and 2 show in front and top view, respectively, an apparatus for pressing printing products, these printing products being arranged in an imbricated formation.
Figure 2:
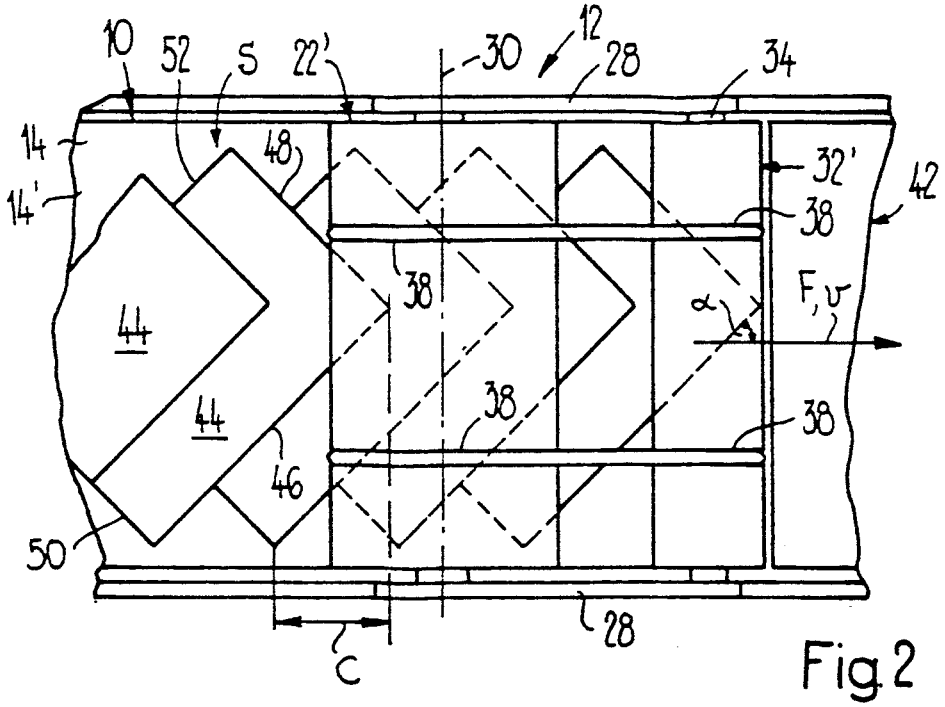

FIGS. 1 and 2 show, in a highly simplified manner, a pressing apparatus 12 which follows downstream, viewed in the conveying direction F, a belt conveyor 10. The endless belt 14, driven so as to circulate in the conveying direction F, of the belt conveyor 10 is, at its active conveying end, guided about a fixed, rotatably mounted roller 16. The active conveying side 14' defines a conveying plane which is indicated in broken lines and designated by 18.

The pressing apparatus 12 has two pressing rolls 20, 20' arranged above one another and whose cylindrical surfaces 22, 22' define a pressing nip 24. The inlet 26 to the pressing nip 24, and facing the belt conveyor 10 is likewise established by the surfaces 22, 22' approaching one another in the conveying direction F. The two pressing rolls 20, 20' are driven in the direction of arrow A and A', respectively, such that the circumferential speed corresponds to the conveying speed $v$ of the belt conveyor 10.

The lower pressing roll 20 is rotatably mounted and fixed on lateral bearing plates 28, the surface 22 of this pressing roll 20 being tangential to the conveying plane 18.

The upper pressing roll 22' is displaceably mounted on the bearing plates 28 in the direction of arrow B, approximately perpendicular to the conveying plane 18, and is pretensioned toward the lower pressing roll 20. The axis of rotation 30 of the lower pressing roll 20 runs parallel to the conveying plane 18 and at right angles to the conveying direction F, whereas the axis of rotation 30 of the upper pressing roll 20' may pivot about an axis running approximately parallel to the conveying direction F, retaining its longitudinal direction running at right angles to the conveying direction F.

The two pressing rolls 20, 20' are each followed downstream by a guide roll 32, 32' which is likewise mounted on the bearing plates 28. The axes of rotation 34 of these guide rolls 32, 32' run parallel to the axes of rotation 30 of the pressing rolls 20, 20'. The lower guide roll 32 is likewise tangential to the conveying plane 18 with its cylindrical shell surface 36. The upper guide roll 32' is, in the same way as the upper pressing roll 20', guided displaceably in the direction of arrow B and pretensioned toward the lower guide roll 32. The pressing rolls 20, 20' and guide rolls 32, 32' have two continuous grooves 38 which correspond to one another, are spaced apart from one another in the direction of the axes of rotation 30, 34 and in which engage two endless belts 40 in each case guided about a pressing roll 20, 20' and the corresponding guide roll 32, 32'. The depth of the grooves 38 in the radial direction essentially corresponds to the thickness of the belts 40 such that these belts do not project above the surfaces 22, 22' or shell surfaces 36.

The pressing apparatus 12 is followed downstream by a removal conveyor 42 which is likewise designed as a belt conveyor and is driven in the conveying direction F at the speed $v$.

Multi-sheet, folded printing products such as periodicals, newspapers and the like, which are arranged in an imbricated formation S, are designated by 44. Each printing product 44 lies, viewed in the conveying direction F, on the preceding printing product 44. The folded edges of the printing products 44 are designated by 46. the side edges by 48 and 50, respectively, and the open edge lying in each case opposite the folded edge 46, the so-called fore-edge, by 52. The printing products 44 are rotated, with respect to the conveying direction F, in each case about an axis standing perpendicular to the conveying plane 18 such that the edges 46 to 52 run inclined with respect to the conveying direction F. The folded edges 46 enclose, with the conveying direction F, an angle $\alpha$ of approximately 45°. This angle may, of course, be larger or smaller. However, it is preferably in the range between 10° and 8°. The folded edges 46 of two adjacent printing products 44 overlap one another, viewed in the conveying direction F, in a region designated by C but are spaced apart from one another in a direction at right angles to the conveying direction F and parallel to the conveying plane 18.

Figure 3:
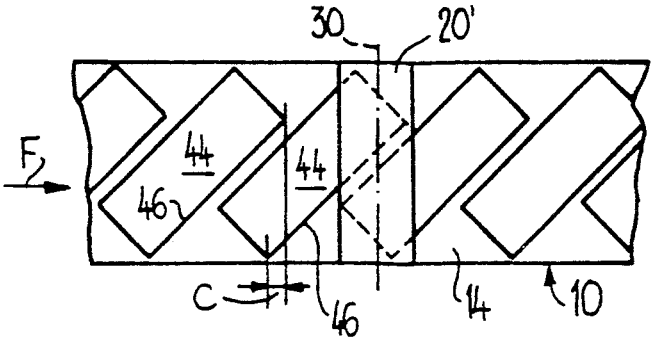
FIG. 3 shows the printing products to be pressed in a different formation.

FIG. 3 shown in plan view, in a highly simplified manner, a further embodiment of the present invention. The belt 14 of the belt conveyor 10 runs through the pressing nip 24 defined by the two pressing rolls 20, 20' (cf. FIG. 1), of which only the upper one can be seen in FIG. 3. The pressing rolls 20, 20' are driven in a known manner of rotation about the axes of rotation 30. The printing products 44 lying on the belt 14 are arranged inclined with respect to the conveying direction F, overlap one another regionwise in the conveying direction F, yet do not lie on one another. Instead, viewed in a direction at right angles to the conveying direction F, in each case the printing products lie next to one another regionwise. The folded edges 46 of two adjacent printing products 44 overlap one another, viewed in the conveying direction F, in the region C. The printing products 44, lying on the belt 14, are conveyed to the pressing rolls 20, 20', are conveyed through the pressing rolls, and then are conveyed away from the pressing rolls.

As a result of the printing products 44 being inclined with respect to the conveying direction F, these printing products are fed to the inlet 26 of the pressing nip 24 with a leading corner defined by the folded edge 46 and side edge 48. In the course of the further conveying of the printing products 44, the pressing roll 20 in fact rolls gradually along the folded edge 46. In doing so, it creates a similar effect to a folding stick drawn along the folded edge 46, which results in an especially good pressing. The air contained in the region of the folded edge 46 inside the fed printing products 44 is thus gradually pushed out of the printing products 44. The time available for the air to escape is in fact at least the amount of time which elapses until the entire folded edge 46 has entered the pressing nip 24 through the inlet 26. Moreover, because the printing products are inclined with respect to the conveying direction F, the thickness, at right angles to the conveying plane 18, of the fed formation is essentially constant. The folded edges 46 are offset laterally with respect to one another and overlap one another in the conveying direction F such that the pressing rolls 20, 20' run over the folded edge 46 of a printing product 44 before they run off the folded edge 46 of the preceding printing product 44, viewed in the conveying direction F. This results in an especially smooth running of the pressing apparatus 12.

The belts 40 guide the printing products 44 in a region following downstream from the pressing nip 24 and thus prevent the printing products 44 from being carried along the surfaces 22, 22' and bending in a direction at right angles to the conveying plane 18. Of course, the belts 40 and guide rolls 32, 32' are not, however, absolutely necessary for pressing the printing products 44.

It is, of course, also conceivable for the printing products to enter the pressing nip in an imbricated formation in which, viewed in the conveying direction, each printing product is covered by the preceding printing product. In this case, the surface of the lower pressing roll in each case rolls on the preceding folded edge. Furthermore, because the printing products are inclined with respect to the conveying direction, it is also possible to press multi-sheet, folded printing products in which the folded edge, viewed in the conveying direction, is in each case trailing (in this case the edge 52 in FIG. 2 would correspond to the folded edge). In this case too, one pressing roll rolls gradually along the folded edge, whereby the air which has accumulated in the region of the folded edge in the printing product can likewise again escape without difficulty.

While the invention has been described with reference to particular preferred embodiments, the invention is not limited to the specific examples given, and other embodiments and modifications can be made by those skilled in the art without departing from the spirit and scope of the invention.

What is claimed is:

1. A process for pressing multi-sheet folded printing products comprising the steps of:

conveying the multi-sheet folded printing products into an inlet extending essentially at right angles to a conveying direction of the multi-sheet folded printing products of a pressing nip defined by two pressing surfaces revolving approximately in the conveying direction, pressing the multi-sheet folded printing products together when said products pass through the pressing nip, and feeding the multi-sheet folded printing products in an imbricated formation with a corner of the multi-sheet folded printing product leading into the inlet, with edges inclined at an angle with respect to the conveying direction.

2. The process according to claim 1, wherein the printing products are conveyed with one end of a folded edge leading in the conveying direction.

3. The process according to claim 1, wherein the printing products are conveyed in an imbricated formation in which each printing product lies on the preceding printing product in the conveying direction.

4. The process according to claim 1, wherein the printing products are conveyed in an imbricated formation in which each printing product lies on the following printing product in the conveying direction.

5. A process for pressing multi-sheet folded printing products comprising the steps of:

conveying the multi-sheet folded printing products into an inlet extending essentially at right angles to a conveying direction of the multi-sheet folded printing products of a pressing nip defined by two pressing surfaces revolving approximately in the conveying direction, pressing the multi-sheet folded printing products together when said products pass through the pressing nip, and feeding the multi-sheet folded printing products into the inlet with edges inclined at an angle with respect to the conveying direction, wherein the multi-sheet folded printing products are conveyed in an unimbricated formation with folded edges thereof overlapping one another in the conveying direction and lying next to one another regionwise.

6. The process according to claim 5, wherein the multi-sheet folded printing products are conveyed with one end of a folded edge leading in the conveying direction.

* * * * *